US006004226A

United States Patent [19]

Asakura

[11] Patent Number: 6,004,226

[45] Date of Patent: Dec. 21, 1999

[54] SOLID GOLF BALL

[75] Inventor: Takeshi Asakura, Shirakawa, Japan

[73] Assignee: Sumitomo Rubber Industries, Ltd., Hyogo-ken, Japan

[21] Appl. No.: 09/018,249

[22] Filed: Feb. 3, 1998

[30] Foreign Application Priority Data

Feb. 3, 1997 [JP] Japan ..... 9-020434

[51] Int. Cl.[6] ..... A63B 37/06; A63B 37/12

[52] U.S. Cl. ..... 473/373; 473/374; 273/DIG. 10

[58] Field of Search ..... 473/373, 374; 273/DIG. 10

[56] References Cited

U.S. PATENT DOCUMENTS 4,781,383 11/1988 Kamada et al. .
5,184,828 2/1993 Kim et al. .
5,439,227 8/1995 Egashira et al. .
5,779,562 7/1998 Melvin et al. ..... 473/373

FOREIGN PATENT DOCUMENTS

0637459A1 2/1995 European Pat. Off. .
2245580A 1/1992 United Kingdom .
2313789 12/1997 United Kingdom .

*Primary Examiner*—George J. Marlo

[57] ABSTRACT

A solid golf ball having good shot fee, high spin amount and excellent durability and having an intermediate layer formed on the core, and a cover covering the intermediate layer, wherein the cover has a Shore D hardness of 40 to 55, the core has a diameter of 31 to 36 mm and a JIS-C hardness of 60 to 85, the intermediate layer has a lower JIS-C hardness than that of the core by 5 to 25, and the average specific gravity of the core and the intermediate layer is within the range of from not less than 1.0 to less than 1.3. The intermediate layer and the core are formed from a vulcanized molded rubber composition comprising a base rubber, a metal salt of an unsaturated carboxylic acid, an organic peroxide and a filler.

3 Claims, 1 Drawing Sheet

SOLID GOLF BALL

FIELD OF THE INVENTION

The present invention relates to a solid golf ball. More particularly, it relates to a solid golf ball comprising a core, an intermediate layer formed on the core, and a cover covering the intermediate layer.

BACKGROUND OF THE INVENTION

Hitherto, many golf balls have been commercially sold, but they are typically classified into thread wound golf balls and solid golf balls. The solid golf ball is further classified into a two-piece golf ball and a three-piece golf ball. The solid golf ball is generally approved or employed by most of amateur golfers, because it has better durability and better flight distance than the thread wound golf ball. On the other hand, the thread golf ball is generally approved or employed by professional golfers or high level amateur golfers, because it has a better shot feel and a higher spin amount than the solid golf ball.

The two-piece golf ball is generally inferior to the thread golf ball in shot feel and controllability on approach shots. The improvement in shot feel and controllability for approach shots in a two-piece golf ball has been intensely studied. It has also been proposed that its core is made of two layers, whereby the resulting golf ball has more excellent shot feel than the two-piece golf ball.

Golf balls having a two-layer structured core are described, for example, in Japanese Patent Kokai Publication Nos. 241464/1985, 181069/1987 and 80377/1989. These golf balls have one common structural feature, that is, that the hardness of the outer core is higher than that of the inner core. That is, making the inside of the core softer than the outside largely deforms the golf ball when hit by a club and provides the golf ball with a soft shot feel. However, a golf ball having such a structure has poor durability.

Japanese Patent Kokai Publication No. 23069/1994 proposes that the hardness of a core is made softer as it is farther from the boundary between the inner core and the outer core. In this structure, however, the inner core shows poor rebound characteristics and reduces the flight distance of the golf ball, because the inside of the inner core is softer than the outside.

OBJECTS OF THE INVENTION

A main object of the present invention is to provide a solid golf ball having good shot feel, high spin amount and excellent durability.

According to the present invention, the object described above has been accomplished by placing an intermediate layer between a core and a cover and adjusting the hardness of the core, the intermediate layer and the cover, the diameter of the core, and the average specific gravity of the core and the intermediate layer to a specified range, thereby providing a solid golf ball having good shot feel, high spin amount and excellent durability.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
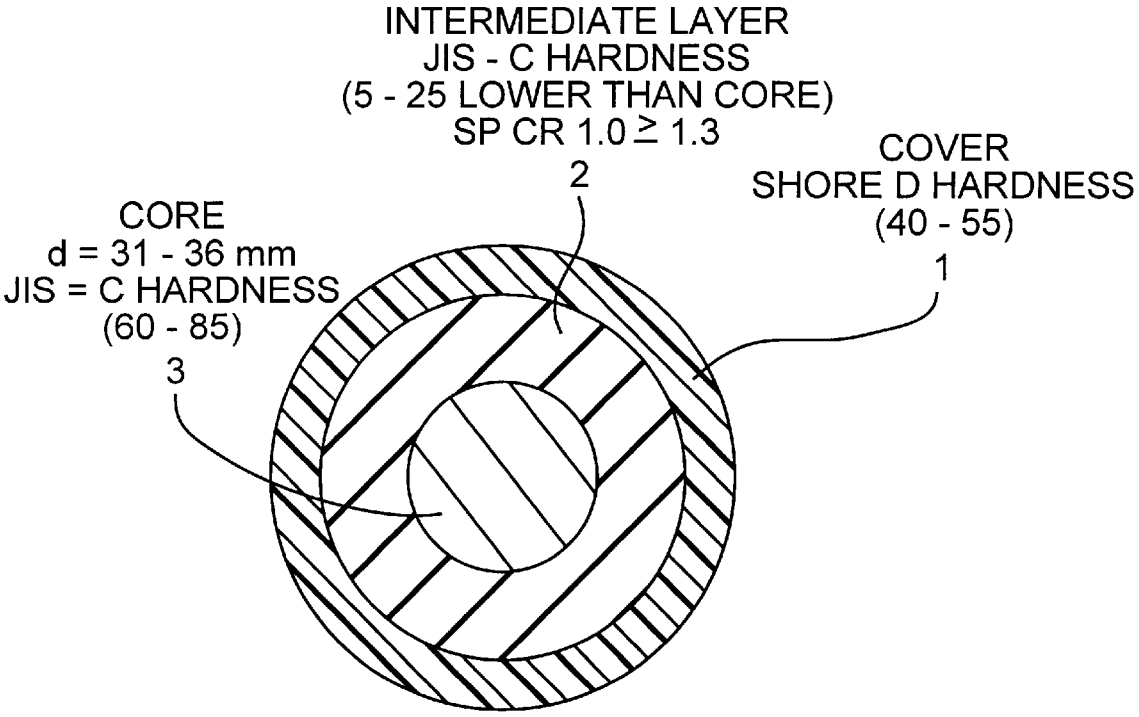
FIG. 1 is a schematic cross section illustrating one embodiment of the golf ball of the present invention.

The present invention provides a solid golf ball comprising a core, an intermediate layer formed on the core, and a cover covering the intermediate layer, wherein the cover has a Shore D hardness of 40 to 55, the core has a diameter of 31 to 36 mm and a JIS-C hardness of 60 to 85, the intermediate layer has a lower JIS-C hardness than that of the core by 5 to 25, and an average specific gravity of the core and the intermediate layer is within the range of from not less than 1.0 to less than 1.3.

DETAILED DESCRIPTION OF THE INVENTION

The solid golf ball of the present invention will be explained with reference to the accompanying drawing. FIG. 1 is a schematic cross section illustrating one embodiment of the solid golf ball of the present invention. In FIG. 1, 3 is a core, 2 is an intermediate layer formed on the core and 1 is a cover covering the intermediate layer.

Both the core 3 and the intermediate layer 2 are composed of a rubber molded article. The core 3 is obtained by vulcanizing or press-molding a rubber composition in a mold having a spherical cavity. The rubber composition typically comprises a base rubber, a metal salt of an unsaturated carboxylic acid, an organic peroxide, a filler and the like. The vulcanization is generally conducted by heating at 140 to 170° C.

The base rubber may be natural rubber and/or synthetic rubber which has been conventionally used for solid golf balls. Preferred is high-cis polybutadiene rubber containing a cis-1,4 bond of not less than 90%, preferably not less than 95%. The base rubber may be optionally mixed with natural rubber, polyisoprene rubber, styrene-butadiene rubber, ethylene-propylene-diene rubber (EPDM), and the like.

The metal salt of unsaturated carboxylic acid, which acts as a co-crosslinking agent, includes mono or divalent metal salts, such as zinc or magnesium salts of $\alpha,\beta$-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. An amount of the metal salt of the unsaturated carboxylic acid in the rubber composition is 15 to 35 parts by weight, preferably from 15 to 28 parts by weight, based on 100 parts by weight of the base rubber. When the amount of the metal salt of the unsaturated carboxylic acid is larger than 35 parts by weight, the core is too hard, and thus shot feel is poor. On the other hand, when the amount of the metal salt of the unsaturated carboxylic acid is smaller than 15 parts by weight, the core is soft. Therefore, rebound characteristics are degraded to reduce flight distance.

The organic peroxide, which acts as a crosslinking agent or a hardener, includes, for example, dicumyl peroxide, 1,1-bis(t-butylperoxy)-3,3,5-trimethyl cyclohexane, 2,5-dimethyl-2,5-di(t-butylperoxy)hexane, di-t-butyl peroxide and the like. Preferred organic peroxide is dicumyl peroxide. An amount of the organic peroxide is from 0.3 to 5.0 parts by weight, preferably 0.5 to 3.0 parts by weight, based on 100 parts by weight of the base rubber. When the amount of the organic peroxide is smaller than 0.3 parts by weight, the core is too soft. Therefore, rebound characteristics are degraded to reduce flight distance. On the other hand, when the amount of the organic peroxide is larger than 5.0 parts by weight, the core is too hard, and thus shot feel is poor.

The filler, which can be typically used for the core of golf ball, includes for example, inorganic filler (such as zinc oxide, barium sulfate, calcium carbonate and the like), high specific gravity metal powder filler (such as powdered tungsten, powdered molybdenum, and the like), and the mixture thereof. An amount of the filler is not limited and can vary depending on the specific gravity and size of the cover and core, but is preferably from 10 to 50 parts by weight, based on 100 parts by weight of the base rubber. When the amount of the filler is smaller than 10 parts by weight, it is difficult to adjust a weight of the resulting golf ball. On the other hand, when the amount of the filler is larger than 50 parts by weight, a weight ratio of a rubber component in the core is too low. Therefore, rebound characteristics of the resulting golf ball are degraded.

The rubber composition for the core of the present invention can contain other components which have been conventionally used for preparing the core of solid golf balls, such as organic sulfide compound or antioxidant. If used, an amount of the organic sulfide compound is preferably 0.5 to 2.0 parts by weight, and an amount of the antioxidant is preferably 0.2 to 0.5 parts by weight, based on 100 parts by weight of the base rubber.

In the solid golf ball of the present invention, the core preferably has a hardness distribution so that a hardness difference between its center and the other portion in the core is −10 to 10%. The term "hardness" described above refers to a JIS-C hardness, which can be measured with a JIS-C hardness meter. The core has a hardness distribution based on a hardness of its center of −10 to 10% as described above, thereby it means that the core has an approximately uniform hardness distribution from its center to the surface, and thus rebound characteristics are improved. The resulting golf ball has a high launch angle to increase the flight distance by providing the intermediate layer 2 having lower hardness than that of the core. Therefore, the resulting golf ball has better shot feel at the time of hitting. The specific gravity of the core itself is preferably 1.0 to 1.3. The term "hardness of the core" as used herein refers to a hardness, which is obtained by cutting the core in two equal parts and then measuring the hardness from the inner side to the outer side of the core at regular intervals to take the average of measured values at each location of measurement. A hardness of the intermediate layer is also obtained by cutting the intermediate layer in two equal parts and then measuring the hardness from the inner side to the outer side of the intermediate layer at regular intervals to take the average of measured values at each location of measurement in the same manner as the core.

The intermediate layer 2 is formed on the spherical core. The method of forming the intermediate layer of the present invention is not specifically limited, but it may be prepared by forming a layer of a rubber composition for forming the intermediate layer on the vulcanized core 3 and then vulcanizing or press-molding it at a suitable temperature. The rubber composition is formed into a semi-spherical half-shell in advance, and two of the half-shells are covered on the core to form a layer on the core.

The intermediate layer 2 is also obtained by vulcanizing or press-molding a rubber composition comprising the same components as the core. However, since the intermediate layer preferably has lower hardness (JIS-C hardness) than that of the core by 5 to 25 as described above, the amount of a metal salt of an unsaturated carboxylic acid in the intermediate layer is preferably smaller than the amount of the metal salt in the core. That is, the amount of the metal salt of the unsaturated carboxylic acid in the intermediate layer is smaller than the amount of said metal salt in the core by about 6 to 13 parts by weight. An absolute amount of the metal salt of the unsaturated carboxylic acid in the intermediate layer is 12 to 30 parts by weight, based on 100 parts by weight of the base rubber, but a specific gravity of the intermediate layer is preferably 1.0 to 1.3, which is the same as the core.

The integrally molded article of the intermediate layer and the core has a diameter of 37.6 to 40.5 mm, preferably 38.2 to 39.6 mm. The integrally molded article preferably has a specific gravity of 1.0 to 1.3 as a whole.

The cover 1 is then covered on the intermediate layer. The cover may be formed from a material which has been conventionally used for preparing the cover of solid golf balls as long as it has a Shore D hardness of 40 to 55. The cover of solid golf balls is generally formed from an ionomer resin or a combination of the ionomer resin with the other resin (such as a soft elastomer). The ionomer resin is an ethylene-(meth)acrylic acid copolymer, of which a portion of carboxylic acid groups is neutralized with metal ion.

The metal ion which neutralizes a portion of the carboxylic acid groups of the copolymer includes alkali metal ion, such as sodium ion, potassium ion, lithium ion and the like; divalent metal ion, such as zinc ion, calcium ion, magnesium ion, and the like; trivalent metal ion, such as aluminum ion, neodymium ion, and the like; and the mixture thereof. Preferred are sodium ion, zinc ion, lithium ion and the like, in view of rebound characteristics, durability and the like. The ionomer resin is not limited, but examples thereof will be shown by a trade name thereof. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resin, which is commercially available from Exxon Chemical Co., include Iotec 7010, Iotec 8000, and the like. These ionomer resins are used alone or in combination.

The cover used in the present invention may be a heated mixture of the ionomer and a soft elastomer. Examples of the soft elastomer include:

- maleic anhydride modified thermoplastic elastomer;
- epoxy group modified thermoplastic elastomer, such as epoxy-group containing SBS (styrene-butadiene-styrene) structure block copolymer or epoxy-group containing SIS (styrene-isoprene-styrene) structure block copolymer;
- thermoplastic elastomers having terminal OH groups, such as SEBS (styrene-ethylene-butadiene-styrene) structure block copolymer or SEPS (styrene-ethylene-propylene-styrene) structure block copolymer; or
- the combination thereof.

In this context, the term "SBS structure" means polystyrene-polybutadiene-polystyrene structure in which polybutadiene block is sandwiched by two polystyrene blocks.

It is preferable that an amount of the ionomer resin is 20 to 80% by weight, and an amount of the other soft elastomer is 80 to 20% by weight.

Examples of the maleic anhydride modified thermoplastic elastomer include ethylene-ethyl acrylate-maleic anhydride terpolymer resins, which are commercially available from Sumitomo Chemical Industries, Ltd. under the trade name of "Bondine" in various grades.

Examples of the epoxy group modified thermoplastic elastomer include glycidyl methacrylate adducts of hydrogenated styrene-butadiene-styrene block copolymers, which are commercially available from Asahi Chemical Industries, Ltd. under the trade name of "Taftek Z514" and "Taftek Z513"; or SBS (styrene-butadiene-styrene) structure block copolymers having a polybutadiene block with epoxy groups, of which a portion of the polybutadiene block is hydrogenated, which are commercially available from Daicel Chemical Industries, Ltd. under the trade name of "ESB AT014" and "ESB AT015". They are suitably used in the present invention.

Examples of the SEBS structure block copolymer or SEPS structure block copolymer having terminal OH groups include, hydrogenated styrene-isoprene-styrene block copolymer having terminal OH groups, which is commercially available from Kuraray Co., Ltd. under the trade name of "HG-252".

The cover used in the present invention preferably has a Shore D hardness of 40 to 55. Good spin performance and good durability can be imparted to the resulting golf ball by making the cover hardness lower.

The cover used in the present invention may optionally contain pigments (such as titanium dioxide, etc.), and the other additives such as an antioxidant, a UV absorber, a photostabilizer and a fluorescent agent or a fluorescent brightener, etc., in addition to the resin component, as long as the addition of the additives does not deteriorate the desired performance of the golf ball cover, but an amount of the pigment is preferably from 0.1 to 0.5 parts by weight based on 100 parts by weight of the cover resin component.

The cover 3 used in the present invention is formed by a conventional method for forming golf ball cover well known in the art, such as injection molding, press-molding and the like. The cover preferably has a thickness of 1 to 5 mm. At the time of cover molding, many depressions called "dimples" may be optionally formed on the surface of the golf ball. Furthermore, paint finishing or marking stamp may be optionally provided after cover molding for serving commercial sell.

EXAMPLES

The following Examples and Comparative Examples further illustrate the present invention in detail but are not to be construed to limit the scope of the present invention.

Examples 1 to 7 and Comparative Examples 1 to 3

Solid golf balls of Examples 1 to 7 and Comparative Examples 1 to 3 were made by the following steps (i) to (iv).

(i) Production of cores

The core rubber compositions A to G shown in Table 1 were prepared, and then vulcanized by press-molding at the conditions described therein to obtain spherical cores. The specific gravity of the resulting spherical cores was measured, and the result is shown in Table 1. Amount of component in Table 1 is represented by parts by weight.

TABLE 1

| Core composition | A | B | C | D | E | F | G |
|---|---|---|---|---|---|---|---|
| BR-18 *1 | 100 | 100 | 100 | 100 | 100 | 100 | 100 |
| Zinc acrylate | 28 | 25 | 22 | 19 | 15 | 22 | 28 |
| Zinc oxide | 18.5 | 19.6 | 20.7 | 21.8 | 23.3 | 20.7 | 13.5 |
| Antioxidant *2 | 0.5 | 0.5 | 0.5 | 0.5 | 0.5 | 0.5 | 0.5 |
| Dicumyl peroxide | 1.0 | 1.0 | 1.0 | 1.0 | 1.0 | 1.0 | 1.0 |
| Diphenyl disufide | — | — | — | — | — | — | 0.5 |
| Specific gravity | 1.16 | 1.16 | 1.16 | 1.16 | 1.16 | 1.16 | 1.13 |
| Vulcanization condition (° C. × minutes) | *3 | *3 | *3 | *3 | *3 | *4 | *3 |

*1: High-cis-1,4-polybutadiene (trade name "BR-18") from Japan Synthetic Rubber Co., Ltd.
*2: Antioxidant (trade name "Yoshinox 425") from Yoshitomi Pharmaceutical Inds., Ltd.
*3: 140° C. × 30 minutes + 165° C. × 8 minutes
*4: 165° C. × 20 minutes The cores for Examples 1 to 7 and Comparative Examples 1 to 3 were respectively prepared. Diameter and hardness distribution of the resulting cores were measured, and the results are shown in Table 4.

(ii) Formation of intermediate layer

The intermediate layer compositions a to f shown in Table 2 were coated on the resulting core by press-molding, and then vulcanized at 150° C. for 20 minutes to obtain spherical integrally molded articles having a diameter of 39 mm. The specific gravity of intermediate layer formulation was measured, and the result is shown in Table 2. Amount of component in Table 2 is represented by parts by weight.

TABLE 2

| Intermediate layer composition | a | b | c | d | e | f |
|---|---|---|---|---|---|---|
| BR-18 *1 | 100 | 100 | 100 | 100 | 100 | 100 |
| Zinc acrylate | 22 | 19 | 15 | 31 | 17 | 22 |
| Zinc oxide | 20.7 | 21.8 | 23.3 | 17.4 | 22.6 | 10.0 |
| Antioxidant *2 | 0.5 | 0.5 | 0.5 | 0.5 | 0.5 | 0.5 |
| Dicumyl peroxide | 1.0 | 1.0 | 1.0 | 1.0 | 1.0 | 1.0 |
| Diphenyl disulfide | — | — | — | — | — | 0.5 |
| Tungsten | — | — | — | — | — | 20.9 |
| Specific gravity | 1.16 | 1.16 | 1.16 | 1.16 | 1.16 | 1.25 |

*1: High-cis-1,4-polybutadiene (trade name "BR-18") from Japan Synthetic Rubber Co., Ltd.
*2: Antioxidant (trade name "Yoshinox 425") from Yoshitomi Pharmaceutical Inds., Ltd.

The intermediate layer composition used for Examples, JIS-C hardness of the intermediate layer and hardness difference between the core and the intermediate layer are shown in Table 4 to 6.

(iii) Preparation of cover composition

The cover compositions shown in Table 3 were prepared, and then covered on the spherical integrally molded article by injection molding. Amount of component in Table 3 is represented by parts by weight. Shore D hardness of cover composition was measured, and the result is shown in Table 3.

TABLE 3

| Cover compositions | I | II | III | IV |
|---|---|---|---|---|
| Hi-milan 1855 *5 | 20 | — | — | — |
| Hi-milan AD8511 *6 | 25 | 25 | 20 | — |
| Hi-milan AD8512 *7 | 25 | 25 | 20 | — |
| Taftek Z514 *8 | 20 | — | — | — |
| Bondine AX8390 *9 | 10 | — | — | — |
| ESB AT015 *10 | — | 15 | 15 | — |
| HG-252 *11 | — | 35 | 45 | — |
| Iotec 8000 *12 | — | — | — | 50 |
| Iotec 7010 *13 | — | — | — | 50 |
| Shore D hardness | 54 | 52 | 45 | 72 |

*5: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd., MI = 1.0, flexural modulus = 90 MPa, Shore D hardness = 55

*6: Hi-milan AD8511 (trade name), ethylene-methacrylic acid copolymer ionomer resin obtained by neutralizing with zinc ion, manufactured by DuPont Co., MI = 3.4, flexural modulus = 220 MPa, Shore D hardness = 60

*7: Hi-milan AD8512 (trade name), ethylene-methacrylic acid copolymer ionomer resin obtained by neutralizing with sodium ion, manufactured by DuPont Co., MI = 4.4, flexural modulus = 280 MPa, Shore D hardness = 62

*8: Taftek Z514 (trade name), glycidyl methacrylate adduct of hydrogenated styrene-butadiene-styrene block copolymer, manufactured by Asahi Chemical Industries, Ltd., JIS-A hardness = 84, content of sytrene = about 30% by weight, content of hydrogenated butadiene = about 70% by weight, content of glycidyl methacrylate = about 1% by weight

*9: Bondine AX8390 (trade name), ethylene-ethyl acrylate-maleic anhydride terpolymer resin, manufactured by Sumitomo Chemical Industries Co., Ltd., MI = 7.0, Shore D hardness = 14, content of ethyl acrylate + maleic anhydride = about 32% (content of maleic anhydride = 1 – 4%)

*10: ESBS AT015 (trade name), styrene-butadiene-styrene structure block copolymer having a polybutadiene block with epoxy groups, manufactured by Daicel Chemical Industries, Ltd., JIS-A hardness = 67, styrene/butadiene (weight ratio) = 40/60, content of epoxy = about 1.5–1.7% by weight

*11: HG-252 (trade name), hydrogenated styrene-isoprene-styrene block copolymer having a terminal OH group, manufactured by Kuraray Co. Ltd., JIS-A hardness = 80, content of styrene = 40% by weight

*12: Iotec 8000 (trade name), ethylene-acrylic acid copolymer ionomer resin obtained by neutralizing with sodium ion, manufactured by Exxon Chemical Co., MI = 0.8, flexural modulus = 370 MPa, Shore D hardness = 64

*13: Iotec 7010 (trade name), ethylene-acrylic acid copolymer ionomer resin obtained by neutralizing with zinc ion, manufactured by Exxon Chemical Co., MI = 0.8, flexural modulus = 160 MPa (iv) Production of golf balls The resulting golf ball was polished, and then painted with paint to produce a golf ball having a diameter of 42.7 mm. The cover composition used for Examples and Comparative Examples and the hardness of the cover are shown in Table 4 to 6.

The flight performance (sand wedge), durability and shot feel of the resulting golf balls were measured or evaluated, and the results are shown in Table 4 to Table 6. The test methods are as follows.

TEST METHOD (1) Flight performance

A sand wedge club was mounted to a swing robot manufactured by True Temper Co. and a golf ball was hit at a head speed of 20 m/second. Then, a spin amount was measured as flight performance.

(2) Durability

A No. 1 wood club was mounted to a swing robot manufactured by True Temper Co. and a golf ball was hit at a head speed of 45 m/second, repeatedly. The durability is the number of hit until the golf ball is broken, and is indicated by an index when that of Example 3 is 100.

(3) Shot feel

The shot feel of the golf ball is evaluated by 10 top professional golfers according to a practical hitting test using a No. 1 wood club. The evaluation criteria are as follows. The results shown in the Tables below are based on the fact that not less than 8 out of 10 top professional golfers evaluated with the same criterion about shot feel.

Evaluation criteria:

◎: Very good

○: Good

γ: Fairly good

TABLE 4

| Example No. | 1 | 2 | 3 | 4 |
|---|---|---|---|---|
| (Core) | | | | |
| Composition | B | C | D | B |
| Diameter (mm) | 32 | 36 | 35 | 35 |
| JIS-C hardness distribution | | | | |
| Center point | 78.8 | 74 | 67.5 | 79.5 |
| 5 mm from the center point | 79 | 74 | 68 | 79 |
| 10 mm from the center point | 79 | 74.5 | 67 | 79 |
| 15 mm from the center point | 79.8 | 74 | 67 | 79.6 |
| Surface | 78 | 73 | 65 | 76 |
| (Intermediate layer) | | | | |
| Composition | a | b | c | c |
| JIS-C hardness (JIS-C) | 73 | 67 | 60 | 60 |
| Hardness difference between core and intermediate layer | 5.0 to 6.8 | 6.0 to 7.5 | 5.0 to 8.0 | 16 to 19.6 |
| (Cover) | | | | |
| Composition | I | I | I | I |
| Shore D hardness | 54 | 54 | 54 | 54 |
| Spin amount (rpm) | 7570 | 7340 | 7030 | 7760 |
| Durability | 120 | 110 | 100 | 105 |
| Shot feel | ○ | ◎ | ○ | ◎ |

TABLE 5

| Example No. | 5 | 6 | 7 |
|---|---|---|---|
| (Core) | | | |
| Composition | A | A | G |
| Diameter (mm) | 35 | 35 | 32 |
| JIS-C hardness distribution | | | |
| Center point | 84 | 84 | 77 |
| 5 mm from the center point | 84.5 | 84.5 | 77.5 |
| 10 mm from the center point | 84 | 84 | 77.5 |
| 15 mm from the center point | 84 | 84 | 78.3 |
| Surface | 82 | 82 | 77 |
| (Intermediate layer) | | | |
| Composition | a | a | f |
| JIS-C hardness (JIS-C) | 74 | 74 | 72 |
| Hardness difference between core and intermediate layer | 8.0 to 10.5 | 8.0 to 10.5 | 5.0 to 6.3 |
| (Cover) | | | |
| Composition | II | III | I |
| Shore D hardness | 52 | 45 | 54 |
| Spin amount (rpm) | 7830 | 8210 | 7840 |
| Durability | 125 | 135 | 120 |
| Shot feel | ○ | ○ | ○ |

TABLE 6

| Comparative Example No. | 1 | 2 | 3 |
|---|---|---|---|
| (Core) | | | |
| Composition | C | F | E |
| Diameter (mm) | 27 | 35 | 35 |
| JIS-C hardness distribution | | | |
| Center point | 74 | 65 | 60 |
| 5 mm from the center point | 74 | 67 | 60 |
| 10 mm from the center point | 74 | 68 | 60.5 |
| 15 mm from the center point | — | 73 | 59 |
| Surface | 73 | 75 | 56 |
| (Intermediate layer) | | | |
| Composition | b | e | d |
| JIS-C hardness (JIS-C) | 67 | 64 | 85 |
| Hardness difference between core and intermediate layer | 6.0 to 7.0 | 1.0 to 11.0 | −29 to 24.5 |
| (Cover) | | | |
| Composition | IV | IV | I |
| Shore D hardness | 72 | 72 | 54 |
| Spin amount (rpm) | 6310 | 6090 | 6760 |
| Durability | 70 | 60 | 75 |
| Shot feel | Δ | Δ | Δ |

As is apparent from the comparison of the physical properties of the golf balls of Examples 1 to 7 shown in Tables 4 and 5 with those of the conventional golf balls of Comparative Examples 1 to 3 shown in Table 6, the golf balls of Examples 1 to 7 have higher spin amount, better durability and better shot feel than the golf balls of Comparative Examples 1 to 3. The golf ball of Comparative Example 1 is inferior in shot feel, durability and spin performance to the golf balls of Examples 1 to 7, because the core of the golf ball of Comparative Example 1 has smaller diameter, which is 27 mm, and has higher cover hardness. In the golf ball of Comparative Example 2, the hardness distribution of its core is not uniform but shows a gradient from low to high as reaching the surface. The lowest hardness of the core is 65, and is not so different from the hardness of the intermediate layer, which is 65. Its cover is also made harder for obtaining high rebound characteristics. Therefore, the golf ball of Comparative Example 2 is inferior in spin performance and durability to the golf balls of Examples 1 to 7. The golf ball of Comparative Example 3 is inferior in spin performance and durability to the golf balls of Examples 1 to 7 because the intermediate layer has higher hardness than the core.

What is claimed is:

1. A solid golf ball comprising a core, an intermediate layer formed on the core, and a cover covering the intermediate layer, wherein the intermediate layer and the core are formed from a vulcanized molded rubber composition comprising a base rubber, a metal salt of an unsaturated carboxylic acid, in an organic peroxide and a filler, and wherein the cover has a Shore D hardness of 40 to 54, the core has a diameter of 31 to 36 mm and a JIS-C hardness of 60 to 85, the intermediate layer has a lower JIS-C hardness than that of the core by 5 to 25, and the average specific gravity of the core and the intermediate layer is within the range of from not less than 1.0 to less than 1.3.

2. The solid golf ball according to claim 1, wherein the core has a JIS-C hardness difference between its center and the other portion in the core of −10 to 10%.

3. The solid golf ball of claim 1, wherein the vulcanized molded rubber composition comprises a high-cis polybutadiene rubber containing a cis 1,4 bond of not less than 90%.

* * * * *